US010994899B1

(12) United States Patent
Conners et al.

(10) Patent No.: US 10,994,899 B1
(45) Date of Patent: May 4, 2021

(54) BEVERAGE CAN TOP COVER

(71) Applicants: Christopher David Conners, Mississagua (CA); Randy Fraser Wagg, Amaranth (CA)

(72) Inventors: Christopher David Conners, Mississagua (CA); Randy Fraser Wagg, Amaranth (CA)

( * ) Notice: Subject to any disclaimer, the term of this patent is extended or adjusted under 35 U.S.C. 154(b) by 0 days.

(21) Appl. No.: 16/702,415

(22) Filed: Dec. 3, 2019

(51) Int. Cl.

| | |
|---|---|
| ***B65D 51/18*** | (2006.01) |
| ***B65D 47/04*** | (2006.01) |
| ***B65D 41/62*** | (2006.01) |
| ***B65D 41/18*** | (2006.01) |
| ***B65D 47/26*** | (2006.01) |
| *B65D 43/02* | (2006.01) |

(52) U.S. Cl.
CPC ..... *B65D 47/046* (2013.01); *B65D 41/18* (2013.01); *B65D 41/62* (2013.01); *B65D 47/265* (2013.01); *B65D 43/0212* (2013.01)

(58) Field of Classification Search
CPC ..... B65D 47/046; B65D 41/62; B65D 41/18; B65D 43/0212; B65D 41/0435; B65D 41/0457; B65D 41/0478; B65D 47/265
See application file for complete search history.

(56) References Cited

U.S. PATENT DOCUMENTS

| | | | | | |
|---|---|---|---|---|---|
| 3,289,885 | A * | 12/1966 | Villaveces | B65D 47/265 | 221/288 |
| 3,830,392 | A * | 8/1974 | Kessler | B65D 50/045 | 215/216 |
| 4,301,949 | A * | 11/1981 | Palson | A61L 9/12 | 222/548 |
| 4,611,725 | A * | 9/1986 | Kacalieff | B65D 47/265 | 220/253 |
| 4,792,054 | A * | 12/1988 | Weidman | B65D 47/265 | 220/253 |
| 5,167,338 | A * | 12/1992 | Kick | B65D 47/265 | 220/234 |
| 2004/0031818 | A1* | 2/2004 | Killoran | B65D 47/242 | 222/212 |
| 2005/0087543 | A1* | 4/2005 | Smith | B65D 43/0231 | 221/63 |

FOREIGN PATENT DOCUMENTS

| | | | | |
|---|---|---|---|---|
| GB | 2182027 A * | 5/1987 | B65D 47/265 | |

* cited by examiner

*Primary Examiner* — Vishal Pancholi
*Assistant Examiner* — Bob Zadeh
(74) *Attorney, Agent, or Firm* — Stuart L. Wilkinson

(57) ABSTRACT

A lid assembly for a beverage can has a base and a closure member that can be swiveled relative to the base between a position in which a drinking port in the top of a can is exposed to allow drinking through the port and a position in which the drinking port is covered. The base is snap fitted over a rim at the top of the can.

18 Claims, 2 Drawing Sheets

BEVERAGE CAN TOP COVER

FIELD OF THE INVENTION

This invention relates to covers for beverage cans and has particular but not exclusive application after opening to standardized sized cans for soft, soda, juice and alcoholic beverages.

BACKGROUND OF THE INVENTION

Cans made from aluminum or tin-plated steel are used for a large variety of beverages because, in spite of being lightweight and cheap to produce, they provide the means for relatively robust, sealed containment of drinks. Most beverage cans are made to standard dimensions corresponding to standard beverage volumes. One standard for a large part of the North American sales of beverage cans requires a liquid volume of 355 ml with the can being 2.13 inches in diameter at the top rim. Other standards cover different volumes and different can aspect ratios. Prevailing standards often differ as between different countries or other market regions. Generally, tolerances for the manufacture of cans, including the can diameter and the rim size are very tight. This is important given the relationship of the assembly of the present invention and its application to industry standard cans.

Cans are designed to be opened at the site at which the beverage is to be imbibed so that the contained drink can be drunk either straight from the can or after pouring the drink into a glass or like secondary container. Most, but not all examples of can-opening mechanisms involve configuring the top of the can to facilitate the drinker forming a port in the can top through which the beverage can be imbibed or poured. Examples of such opening mechanism include pull tab, stay-on-tab, pop-tab and press-button. Usually, the port is eccentrically located on the can top as this enables easier both to drink directly from the can and to pour from the can. For a can with no preformed top opening mechanism, tops are opened using a can-piercer which is basically the well-know church-key bottle opener but with the head of the opener having a sharp head to puncture the can top when the opener is levered around the can rim All of these opening mechanisms and methods leave a port in the top of the can through which the contents of the can are often directly drunk. Drinking typically involves pursing the lips so that top lip covers part of the top of the can, the bottom lip covers part of the side of the can but the lips in combination surround the area of the port so as to provide a sealed conduit between the interior of the can and the drinker's mouth. Unless the drinker is very thirsty, the full contents of a can may not be drunk in a single sustained set of gulps. Instead, once an immediate thirst is temporarily quenched, the can is usually set aside for a minute or two before the drinker returns for another pull. During that time, the drinking port is normally left unprotected. Consequently, a fragrance or aroma issues through the port from inside the can and is emitted from the regions of the can that have been touched by the drinker's lips and which therefore bear a layer of the beverage. The fragrance and layer, especially if sweet, can attract insects including stinging insects such as bees and wasps. This can result in the drinker or someone else in the vicinity being stung, which is extremely uncomfortable and even fatal for someone having a severe sting allergy.

SUMMARY OF THE INVENTION

According to one aspect of the invention, there is provided a lid assembly for a beverage can comprising a base having a first plate with a part of the perimeter thereof being on a major arc, an integral arcuate skirt depending from the arcuate perimeter part, a fixture projection on the skirt for engaging with a beverage can upper rim for fixing the base to the can top, the remaining part of the perimeter defining an opening in a nominal circular area centered on the centre of curvature of the major arc, and a closure member having a second plate mounted parallel to and against the first plate for rotation thereof relative to the first plate between positions in which the opening is covered and positions in which the opening is uncovered.

BRIEF DESCRIPTION OF DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
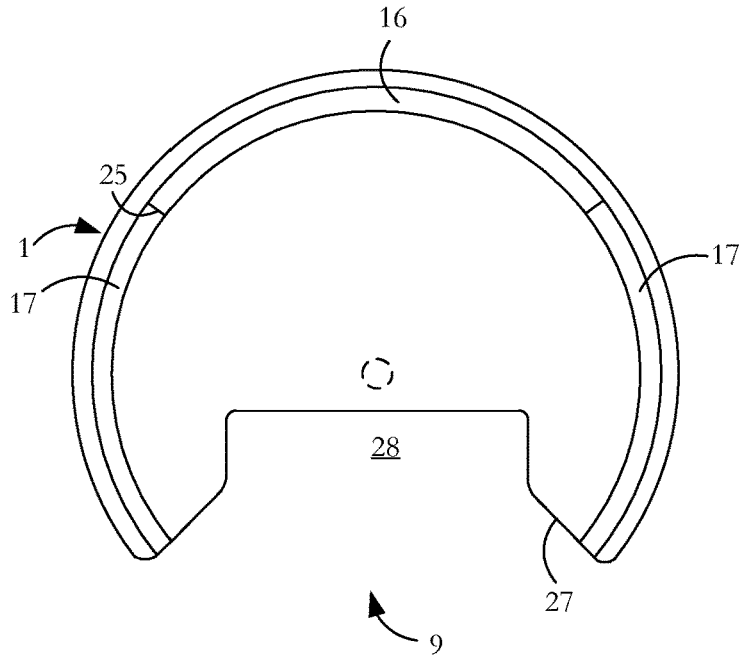
FIG. 1 is view from above of a base forming part of a lid assembly according to an embodiment of the invention.
Figure 2:
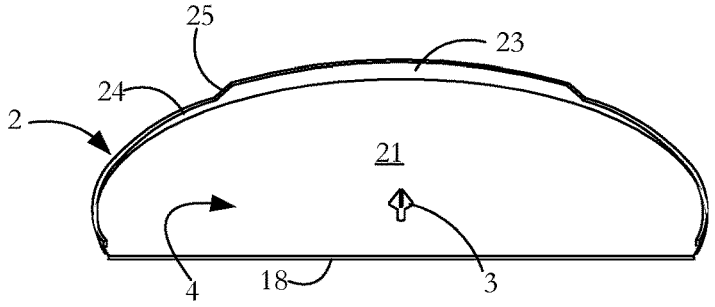
FIG. 2 is an isometric view of the underside of a closure member forming part of the lid assembly referenced above.
Figure 3:
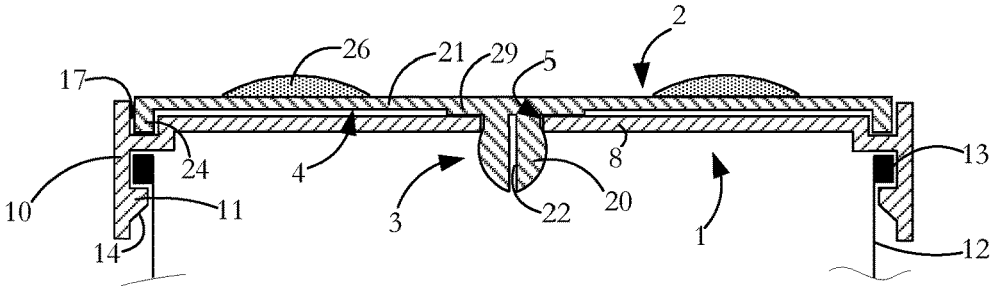
FIG. 3 is a cross-sectional view of the base and closure member assembled to form the lid assembly referenced above, the lid assembly fitted to the top of a beverage can.
Figure 4:
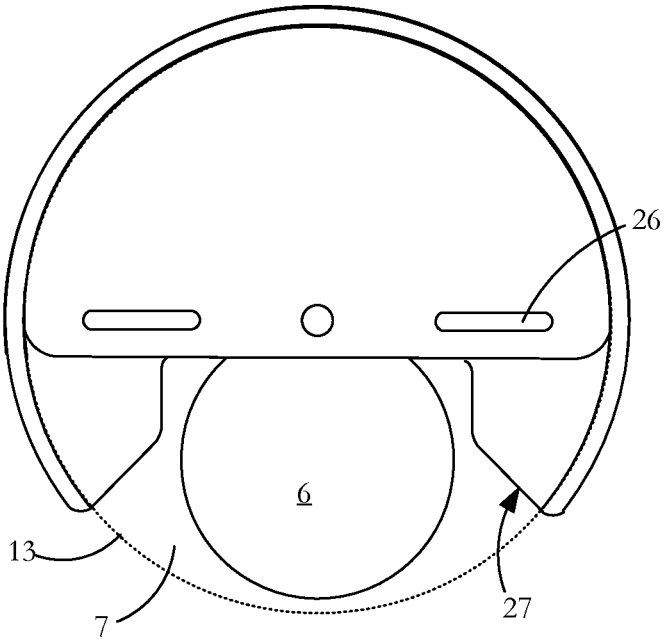
FIG. 4 is a top view of the lid assembly of FIG. 3, the lid assembly fitted to a can top and being in an open position.
Figure 5:
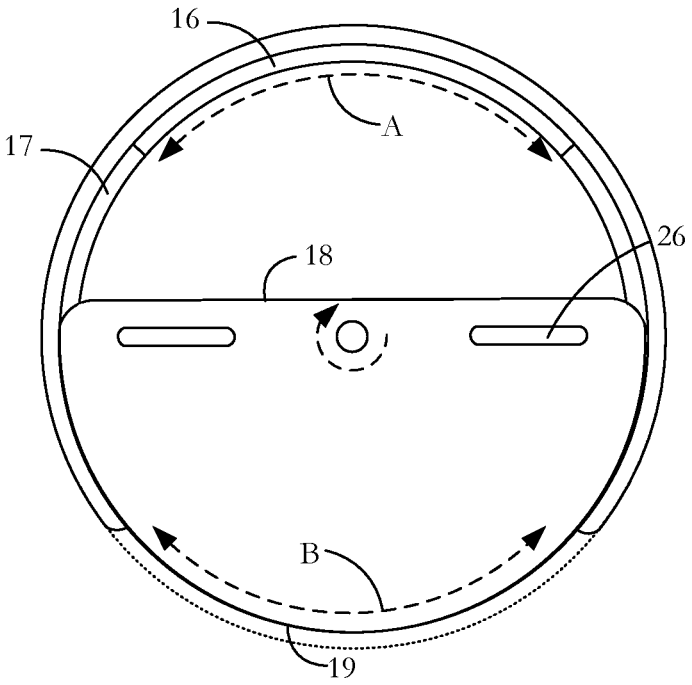
FIG. 5 is a top view of the lid assembly of FIG. 4, the lid assembly being in a closed position.

FIGS. 1 and 2 illustrate parts of a lid assembly for a beverage can top, the parts comprising a base 1 (FIG. 1) and a closure member 2 (FIG. 2). Following assembly, the closure member 2 is attached to the base 1 by a stud 3 extending from a bottom surface 4 of the closure member 2. The stud 3 projects though, and is retained at, an aperture 5 in the base 1 as shown in FIG. 3. The base 1 is shaped and sized to permit it to be clipped onto the top of a beverage can. Once fixed in place, the closure member 2 can be swiveled about an axis of rotation defined by the stud 3 and the aperture 5 between open and closed positions. In an open position, a person is able to drink through an opened port 6 in the top of the can 7 (FIG. 4). In a closed position, the port is covered (FIG. 5).

Referring again to FIGS. 2 and 3, the base 1 is made from molded polypropylene and has a plate 8 of generally circular form but with a re-entrant or cut away region 9. The disc part is in the form of a plate whose areal extent is a major part of a circular area centered on and encompassing the axis of rotation. The region 9 defines a part of the plate perimeter that spans the circular area. In use, the region 9 provides a drinking access area in the base. A skirt 10 depending from a major arc part of the disc perimeter has an inwardly extending flange 11. The radius of the major arc is such that when the base 1 is pressed downwardly onto the top of a standard sized beverage can 7, the skirt 10 is temporarily bent away from the can side surface 12. As the base 1 is pressed further downwardly, the flange 11 clears can rim 13 and the skirt 10 flexes back towards the can side surface 12 with the flange 11 snap fitting under the rim 13 to clip the base 1 in place. The flange 11 has a lower surface 14 which slopes upwardly away from the skirt 10 to facilitate application of the base 1 onto the can top.

As shown in the sectional view of FIG. 3, a radially outer edge part of the plate 8 is relative thicker than the center part. This allows the base to be molded with an edge groove. A central segment 16 of the groove extends between flanking groove segments 17, the central segment 16 being deeper than the flanking segments 17. The base 1 has circular aperture 5 centered on the center of curvature of the major arc edge of the plate 8.

Referring to FIG. 2, the closure member 2 can also be viewed as being of circular disc form but in this case the circle of the disc extends only to a nominal chord to create a straight edge 18.

The remaining perimeter of the closure member is an arcuate edge 19, the major arc of that edge having its center of curvature at the stud 3. The closure member 2 is also in the form of a plate whose areal extent is also a major part of a circular area centered on and encompassing the axis of rotation. In use, a region of the circular area not occupies by the closure member plate provides a drinking access area in the closure member. As shown in FIG. 3, the stud 3 is of bifurcated form having two sections 20 extending from the disc part 21. A gap 22 enables the sections 20 to flex together as the stud 3 is pressed into and through aperture 5 during assembly. This flexure effectively reduces the diameter of the stud 3 allowing the deformed stud to pass through the aperture 5 when the closure member 2 and base 1 are assembled together. The closure member 2 has a wall with a central wall segment 23 extending between flanking segments 24, the central wall segment 23 being higher than the two flanking segments 24. Transitions between the central segment 23 and the flanking segments 24 are not abrupt; they have connecting sloped steps 25. The length of the wall segment 23 is less than the distance A between steps 25 and is less than the distance B between the ends of the groove 16, 17. On the reverse—upper—surface of the closure member, integrally formed tabs 26 are presented facilitating finger/thumb turning of the closure member 2 relative to the base 1.

Once the base 1 and closure member 2 are assembled together, the closure member 2 can be swiveled relative to the base 1 with the axis of relative rotation being the central axis of the stud 3. The stud 3 and aperture 5 have dimensions such that, upon assembly, the closure member 2 has an interference fit with the base 1 meaning that there is some measure of resistance to turning but without making such turning difficult. A radially inner portion 29 of the closure member 2 centered on the axis of relative rotation is relatively thicker than a radially outer region of the disc part 21.

In use, a beverage can 7 is firstly opened by detaching or manipulating a pull tab or the like (not shown) to open a drinking port 6 in the can top. The base 1 is then positioned so that the re-entrant region 9 is located over the drinking port to provide a drinking access area and is snap fitted onto the can top. The dimensions of the base 1 including in particular the flange 11 are set such that, once in place, the base 1 cannot readily be twisted relative to the can 7. The drinker can then swivel the closure member 2 to an open position (FIG. 4) in which the closure member drinking access area is positioned over the drinking port to provide a drinking access area to enable drinking from the can 7. The shape and size of the re-entrant region 9 are such that when the closure member 2 is in a full open position, a drinker with a conventional 'embouchure' will not contact either the plastics material of the base 1 or the closure member 2.

From taste tests, it has been determined that generally the human preference is for lip contact with can metal rather than plastics. The re-entrant region 9 is bounded by rudimentary sector edges 27 which subtend an angle of about 90 degrees at the stud and a generally rectangular area 28 between end of the sector edges 27 and an inner limit of the re-entrant region 9 which is close to, but spaced from the stud/aperture axis. The subtended angle can be within a range of 75 to 105 degrees and the sector edges do not need to be straight; nor does the area 28 have to be rectangular. With the overall shape illustrated, the base covers most of the can top while allowing the user to access substantially the whole of the drinking port 6.

In the fully open position, the high wall segment 23 is located in the deeper central groove segment 16. The arrival of the wall segment 23 at the fully open position when turning provides tactile feedback to the user. Thus, as the closure member 2 is rotated towards the fully open position, the wall part 23 passes over one of the shallow groove segments 17 with the disc part 21 flexing against its retention against the base disc part 8. As a trailing end of the wall segment 23 clears the sloped step 25, tension in the disc part 21 is released and the wall segment 23 drops into the groove segment 16, with this change being transmitted to the finger of the user as he or she moves the closure member 2 to the open position.

Once the drinker has taken a draft or gulp from the can 7, they may want to set the can down for a period of time. To close off the drinking port during that period, the user turns the closure member 2 to the fully closed position shown in FIG. 5. In the fully closed position, the wall segment 23 is located between the closure member sector edges 27. Once again, the arrival of the wall segment 23 at the fully closed position during turning also provides tactile feedback to the user. Thus, as the closure member 2 is rotated towards the fully closed position, the wall segment passes over one of the shallow groove segments 17 with the closure member disc part 21 flexing against its retention in the base 1. As a trailing end of the wall segment 23 clears the sector edge 27, the tension in the disc part 21 is released and the wall segment drops into the re-entrant region 9, with this change being transmitted to the finger of the user as they move the closure member 2 to the closed position.

In one embodiment of the invention, the base is molded from 12 melt flow index (MFI) polypropylene and the closure member is molded from 18 MFI high density polyethylene. Generally, the lower the MFI, the stiffer the material. In this preferred embodiment, the polypropylene is recyclable and the base is marked with the universal recyclability logo PP 5. Similarly, the polyethylene is recyclable and the closure member is marked with the universal recyclability logo HDPE 2. This particular selection of materials provides a satisfactory stiffness with a satisfactory flexibility for the respective functions which the base 1 and closure member 2 must perform. In particular, with proper dimensioning of the base 1 relative to a standard size can 7, the polypropylene base will grip the can 7 when applied and then reapplied almost indefinitely. Polyethylene is used in the closure member in order that the stud 3 deforms as it is pushed though the aperture when assembling the base 1 and swivel member 2 together. The stud 3 resumes its original shape once fully inserted to prevent the closure member being inadvertently disengaged from the base. The assembly can be removed from a can top once the can is empty by a small upward force applied at the overhanging lip of the base 1. The assembly can be reused repeatedly and is washed between uses. The resins and coloring used in the molding of the base and closure member are limited to specifically FDA approved materials given that the product comes into contact with liquids consumed by the general public.

It should be noted that the assembly, when in use, is not completely spill-proof as there must be a small clearance between the relatively moving parts and thus a small gap between the closure member stud 3 and the base aperture 5. However, as well as preventing foreign bodies from falling into or flying through the drinking port, the base and closure member assembly limits spills if the closed can is being transported or if it is accidently tipped over for short period of time.

It is anticipated that the assembly will be used in eating and drinking establishments. For these and similar environments, the assembly can be used for product promotion with space being available on the closure member 2 for advertising and promotional wording which may be represented as applied text and/or graphics or as an embossed (intaglio or cameo) element of the mold. Both the base and the closure member can be embossed or otherwise marked with information showing adherence of constituent materials to FDA and recyclability regulations or standards.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. A lid assembly for a beverage can comprising a base having a first plate and a skirt depending from the first plate, the skirt having a projection thereon for engaging under a part of a rim of the can to attach the first plate to the can, a cover having a second plate mounted parallel to and against the first plate on a side thereof remote from the skirt for rotation of the second plate relative to the first plate about an axis of rotation, the first plate, in areal extent, being a major part of a first circular area, centered on and encompassing the axis, the first plate having a first part of a perimeter thereof spanning the first circular area, the first plate excluding a first drinking access area having a perimeter defined by the first perimeter part and, contiguous thereto, an arc of the first circular area, the second plate, in areal extent, being a major part of a second circular area, centered on and encompassing the axis, the second plate having a second part of a perimeter thereof spanning the second circular area, the second plate excluding a second drinking access area having a perimeter defined by the second perimeter part and, contiguous thereto, an arc of the second circular area, wherein the second plate is rotatable relative to the first plate between a closed position in which the second plate covers the first drinking access area and an open position in which at least a part of the second drinking access area covers at least a part of the first drinking access area.

2. The lid assembly as claimed in claim 1, wherein the skirt follows a circle arc centered on the axis of rotation.

3. The lid assembly as claimed in claim 2, wherein the projection projects radially inwardly from an inside surface of the skirt.

4. The lid assembly as claimed in claim 3, wherein a top surface of the projection extends parallel to a plane of the first plate.

5. The lid assembly as claimed in claim 3, wherein a bottom surface of the projection slopes upwardly from a radially outer limit of the projection to a radially inner limit of the projection.

6. The lid assembly as claimed in claim 1, wherein the first plate has a stud at the axis of rotation and the second plate has an aperture to receive the stud.

7. The lid assembly as claimed in claim 6, the stud being oversize in comparison with the aperture and being resiliently deformable to permit passage of the stud through the aperture.

8. The lid assembly as claimed in claim 7, the stud having two upstanding components with a gap therebetween, wherein the deformation is permitted by the upstanding components flexing towards one another to at least partially close the gap.

9. The lid assembly as claimed in claim 6, wherein the stud and the aperture are shaped and dimensioned to provide an interference fit between the first and second plates.

10. The lid assembly as claimed in claim 1, a top surface of the second plate having a projection extending upwardly therefrom for applied finger/thumb rotation of the second plate relative to the first plate.

11. The lid assembly as claimed in claim 1, wherein the first plate and the second plate are made from food contact substances as prescribed by the United States Food and Drug Administration.

12. The lid assembly as claimed in claim 1, wherein the first and second plates are made from plastics and the plastics of the first plate is more flexible than the plastics of the second plate.

13. The lid assembly as claimed in claim 1, wherein a surface of the second plate faces a surface the first plate, the surface of the second plate has a projection extending therefrom and the projection is received in the first drinking access area in the closed position.

14. The lid assembly as claimed in claim 13, wherein the projection is received in an arcuate groove in the surface of the first plate in the open position.

15. The lid assembly as claimed in claim 13, wherein the projection is an arcuate wall.

16. The lid assembly as claimed in claim 1, wherein a radially inner portion of the second plate centered on the axis of rotation is relatively thicker than a radially outer part of the second plate.

17. The lid assembly as claimed in claim 1, wherein the first plate is made from polypropylene.

18. The lid assembly as claimed in claim 1, wherein the second plate is made from polyethylene.

* * * * *